US008511496B2

(12) United States Patent
Van Der Korput et al.

(10) Patent No.: US 8,511,496 B2
(45) Date of Patent: Aug. 20, 2013

(54) HIGH-CAPACITY CONTAINER

(75) Inventors: Maximus Geradus Maria Van Der Korput, Zutphen (NL); Peter Johannes Gols, Oldeholtpade (NL); Reinhard Lorenz, Uelsen (DE)

(73) Assignee: Schoeller Arca Systems GmbH, Schwerin (DE)

( * ) Notice: Subject to any disclaimer, the term of this patent is extended or adjusted under 35 U.S.C. 154(b) by 206 days.

(21) Appl. No.: 13/063,622

(22) PCT Filed: Sep. 9, 2009

(86) PCT No.: PCT/EP2009/006541

§ 371 (c)(1),
(2), (4) Date: May 16, 2011

(87) PCT Pub. No.: WO2010/031514

PCT Pub. Date: Mar. 25, 2010

(65) Prior Publication Data

US 2011/0220643 A1 Sep. 15, 2011

(30) Foreign Application Priority Data

Sep. 18, 2008 (DE) ..... 10 2008 047 859

(51) Int. Cl.
*B65D 19/02* (2006.01)
*B65D 19/12* (2006.01)

(52) U.S. Cl.
USPC ..... 220/6; 220/4.28; 220/4.08; 220/666; 220/690; 220/691; 220/7

(58) Field of Classification Search
USPC ..... 220/4, 6, 7, 666; 16/321, 319
See application file for complete search history.

(56) References Cited

U.S. PATENT DOCUMENTS 3,048,147 A * 8/1962 McKean ..... 119/496
4,062,467 A * 12/1977 Friedrich ..... 220/7
4,775,068 A 10/1988 Reiland et al.
4,923,079 A 5/1990 Foy (Continued)

FOREIGN PATENT DOCUMENTS

EP 1 818 270 B1 1/2009
WO 9632333 A1 10/1996
WO 2005102852 A1 11/2005

OTHER PUBLICATIONS

International Search Report for PCT International Patent Application No. PCT/EP2009/006541, Dec. 16, 2009.

(Continued)

*Primary Examiner* — Bryon Gehman
*Assistant Examiner* — Gideon Weinerth
(74) *Attorney, Agent, or Firm* — Holland & Hart LLP

(57) ABSTRACT

A large container (2) comprising: a base component (3); four circumferentially arranged side walls (4, 8) of which at least one is attached to the base component (3) through at least one hinge and the at least one side wall is thus foldable towards the base component (3); at least one locking device at the foldable side wall (4) for attaching the foldable side wall (4) in folded up condition at least at one side wall (8) which joins the foldable side wall (4), wherein the locking device is arranged in a recess (10) of the foldable side wall (4), wherein the recess is configured so that the locking device is actuatable from inside and outside the large container (2).

8 Claims, 5 Drawing Sheets

(56) References Cited

U.S. PATENT DOCUMENTS

| | | | | |
|---|---|---|---|---|
| 5,161,709 | A | 11/1992 | Oestreich, Jr. | |
| 5,601,202 | A | 2/1997 | Meacham et al. | |
| 5,632,392 | A * | 5/1997 | Oh | 220/7 |
| 5,853,099 | A * | 12/1998 | Lessard | 220/7 |
| 6,209,742 | B1 * | 4/2001 | Overholt et al. | 220/6 |
| 6,290,081 | B1 * | 9/2001 | Merey | 220/7 |
| 6,293,418 | B1 * | 9/2001 | Ogden et al. | 220/7 |
| 7,159,730 | B2 * | 1/2007 | Rumpel | 220/7 |
| 7,195,128 | B2 * | 3/2007 | Murakami et al. | 220/7 |
| 7,694,836 | B2 * | 4/2010 | Overholt et al. | 220/6 |
| 7,861,878 | B2 * | 1/2011 | Escarpa Gil | 220/7 |
| 8,066,147 | B2 * | 11/2011 | Meers et al. | 220/682 |
| 2004/0222222 | A1 * | 11/2004 | Parnall et al. | 220/6 |
| 2005/0121447 | A1 * | 6/2005 | Barth | 220/6 |
| 2009/0101640 | A1 * | 4/2009 | Hadar | 220/7 |
| 2009/0205169 | A1 * | 8/2009 | Nolan et al. | 16/321 |
| 2012/0006834 | A1 * | 1/2012 | Dubois et al. | 220/666 |
| 2012/0037647 | A1 * | 2/2012 | Cook | 220/666 |

OTHER PUBLICATIONS

International Preliminary Report on Patentability, PCT/EP2009/006541, May 19, 2011 (8 pgs.).

* cited by examiner

HIGH-CAPACITY CONTAINER

The invention relates to a large container with a base component and four side walls. At least one of the four side walls is attached at the base component with at least one hinge and thus foldable towards the base component.

Large containers of this type which are also designated as large cargo carriers typically have dimensions of 800×600 mm and above, in particular approximately 1200×800 mm, 1200×1000 mm and 1200×1600 mm which are standard dimensions. The height of large cargo carriers of this type is a function of the desired receiving capacity. A typical height above the contact surface of the large cargo carrier on the ground up to the upper edge of the side walls is 1000 mm which, however, is not limiting. This provides a definition of the large container over other smaller containers like e.g. fruit and vegetable crates or bottle cases or similar that are stackable on pallets in plural layers above and adjacent to one another. The large containers or large cargo carriers are used in particular for receiving individually packaged goods and are also used for transporting large volume objects in industrial applications, in particular for parts deliveries in the automotive industry but also in the food industry. Large containers of this type are voluminous and are provided with greater thickness and also overall heavier than the typical fruit- and vegetable crates so that transporting full large containers can typically only be performed mechanically in particular through forklifts and similar.

In order simplify emptying such containers but also to reduce the transport volume of such large containers typically used as re-useable containers for return transportation the side walls are foldable either in their entirely or only partially or are foldable one by one, this means that the side walls have to be permanently lockable with one another in transport position. Such locking devices for containers of this type are known in the art. They are engagement lugs that are configured at a side wall and engage a recess of the adjacent side wall or an engagement bar of the adjacent side wall in locking position, thus facilitating the locking. However, opening the locking is complex for large containers or large cargo carriers of this type due to the size of the side walls and partially very difficult since typically two respective locking devices are provided for one side wall which are both arranged at a distance from one another but have to be actuated simultaneously.

Thus, it is an object of the invention to provide a large container with at least one foldable side wall in which a locking and disengagement of the foldable side wall by one operator is provided in a simple manner. According to another aspect of the invention the locking device shall be configured so that it can be actuated from an outside the container and also from an inside of the container in a simple manner.

The object is achieved through features of the independent patent claim 1. Advantageous embodiments are provided in the independent claims.

The invention relates to a large container which includes a base component and in particular four side walls. At least one of the four side walls, preferably two or four are attached at the base component with at least one hinge and thus foldable towards the base component. Each foldable side wall is provided with locking devices and thus preferably with two locking devices which are respectively arranged on both sides of the side wall and in particular at the upper side edge in the corner portion or in the portion proximal to the corner. Each locking device includes a handle component which is configured in particular L-shaped in the upper portion, this means it is provided with a shoulder which defines a handle shoulder at an inner end of the handle component. A hand can be comfortably placed onto the bar shaped shoulder formed by the step and thus the hand can be placed into the step since the step with respect to its length is essentially configured to fit the width of a hand. Each handle component is provided with at least one engagement lug which reaches into an engagement recess or an engagement bar or similar of the adjacent side wall that is arranged at a 90° angle for closing the side wall. The handle component slides on a support member of the side wall for which a support bar is provided protruding in upward direction in particular at the upper side wall edge in the portion of a recess provided for receiving the handle component, wherein a section of the handle component is supported on the support bar. For this purpose the handle component is provided with a groove shaped recess. This configuration of the handle component facilitates that the two locking devices can be actuated from the outside and also from the inside, this means they can be opened or closed. This can be performed by a single operator quite comfortably, wherein the operator grips a respective handle component with one hand and simultaneously moves it inward for opening, this means in the direction of the center of the respective foldable side wall which facilitates disengaging the bar locks. Thus, initially one side wall can be opened from the outside and the additional side walls can then be opened from the inside. Simultaneously, since the operator reaches over the handle bar with the back of his hand or with the hand, he can press the sidewall inward and fold it down after disengagement. Thus moving the hands and similar is not required. This yields a simple and quick opening of the side wall which is configured comparatively large for large containers. In a similar manner a simple closure is possible, wherein the handle component is spring loaded in closing direction. The contact portion for the hand formed through the steps in the handle component can be profiled through rises or bulges which facilitate safe and simple gripping also when the components are wet and slippery. When required the handle surface can also be profiled differently, namely with nips or rounded ribs or lamellas or it can be sprayed with a soft handle material.

In an advantageous embodiment the locking device is arranged proximal to a side edge which forms a portion of the side wall to be folded down and which extends from the base component to the edge of the folded down side wall oriented away from the handle component. Thus, a locking mechanism of the locking device can be configured in a particularly simple and thus reliable manner since no long actuation path has to be covered and separate clutch elements are not required for actuating the engagement lugs.

It is provided in another preferred embodiment that moving a handle element of the locking device to the center of the edge oriented away from the base component disengages the locking between the foldable side wall and the side wall adjacent thereto. Moving the handle element away from the center of the edge oriented away from the base component then facilitates the locking. Also this facilitates a particularly simple and reliable configuration of the locking mechanism since no transmission of the movement of the handle element is required. In case of the spring loading recited supra only the handle components pushed into the opening position have to be left clear, so that locking the side wall can then be performed self acting. The engagement lug is advantageously configured integral with the handle element through injection molding.

A support and/or a stop for the handle element can be performed e.g. through a recess or step in the handle element and a shoulder shaped protrusion at the foldable side wall which can be gripped by the hand from the side. Besides the stop shoulder this forms a support bar for supporting or reaching around with a hand which can have a suitable profile. Gripping the handle elements with a hand once facilitates opening the locking through a lateral movement over the support shoulder and then immediately facilitates folding the wall without moving the hands again. The handle component furthermore includes openings or recesses at its side surfaces, wherein the openings or recesses facilitate particularly intuitive operation of the locking device when the recess is configured arrow shaped, wherein the arrow head is oriented in the opening direction of the locking device. The arrow shape thus intuitively shows the correct actuation direction to the user of the large container. In this context it is particularly advantageous when the foldable side wall includes an arrow shaped protrusion which is configured and arranged so that it engages the arrow shaped protrusion of the handle element and is used as an inner stop and/or support for the handle element in the opening direction and/or in the closing direction of the locking device. This is advantageously provided on both sides of the handle element which facilitates opening from the inside and from the outside.

Alternatively or additionally the handle element can include an additional recess into which a respective protrusion, in particular a bar or a pin of the foldable side wall engages, so that the handle element is supported through the additional recess and the pin and/or finds a stop at the foldable side wall.

Alternatively or additionally the handle element can also be recessed into the side wall, so that the side wall itself forms the stop for the handle element.

Embodiments of the invention are subsequently described in more detail with reference to schematic drawing figures, wherein.

Elements with identical configuration or function are designated with identical reference numerals in all figures.

Figure 1:
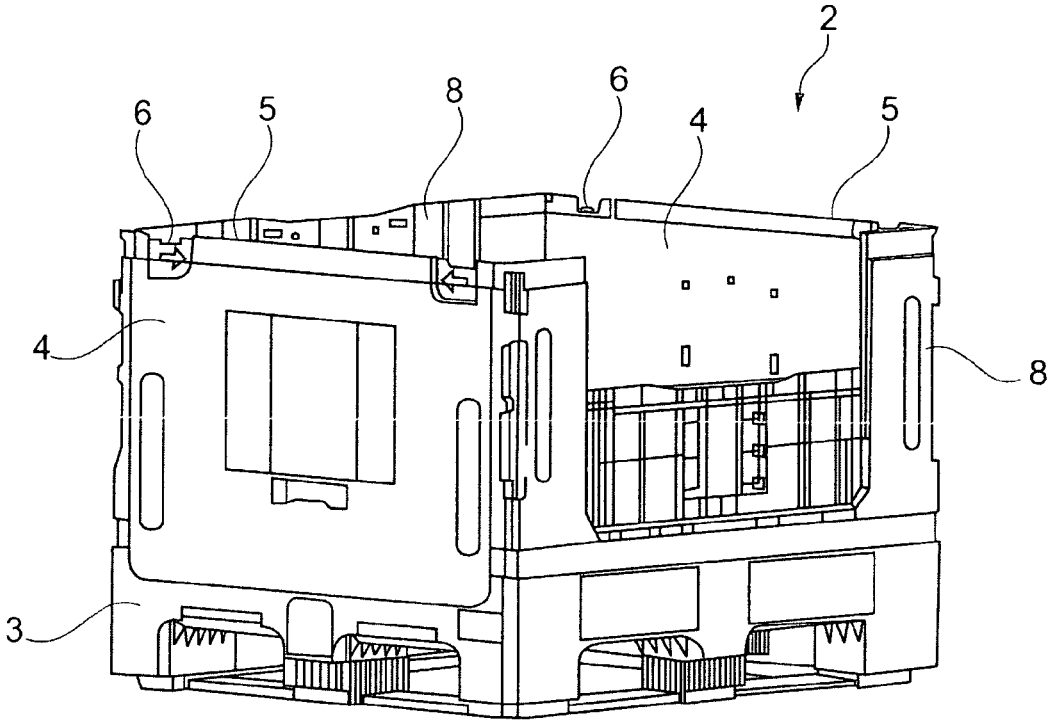
FIG. 1 illustrates a large container.

The large container 2 according to FIG. 1 includes four side walls 4, 8 and a base component 3. At least one of the four side walls 4, 8 is attached in a foldable manner through at least one, preferably plural hinges at the base component 3. When in particular all four side walls 4, 8 are foldable, the base component 3 in the portion of the hinges of the respective side walls 4, 8 includes different elevations so that the side walls 4, 8 are foldable on top of one another in their entirety. Subsequently only the short side walls of the large container 2 are designated as foldable side walls 4. The long side walls disposed there between are configured as adjoining side walls 8. This, however, is not a limitation and furthermore also leaves the foldability of the side walls 8 connected there to undetermined.

The foldable side walls 4 include at least one respective locking device at their edges 5 oriented away from the base component 3, preferably, however, they include two locking devices. Preferably the locking devices are arranged proximal to one respective side edge of the foldable side wall 4, wherein the side edges extend from the base component 3 to the edge 5 of the respective foldable side walls 4 oriented away from the base component 3, thus in particular in the portion of the upper side wall corners.

FIG. 1 illustrates one of the side walls 8 adjoining the foldable side walls 4, wherein the side wall 8 is illustrated partially opened through a flap.

Figure 2:
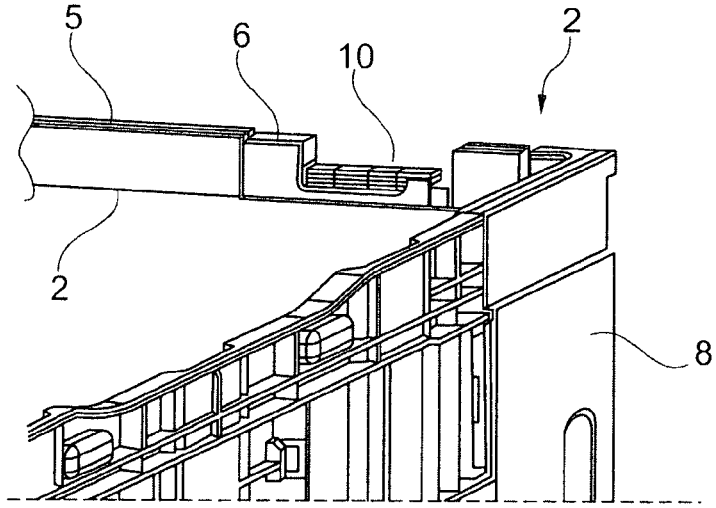
FIG. 2 illustrates a detail view of a corner of a large container.
Figure 3:
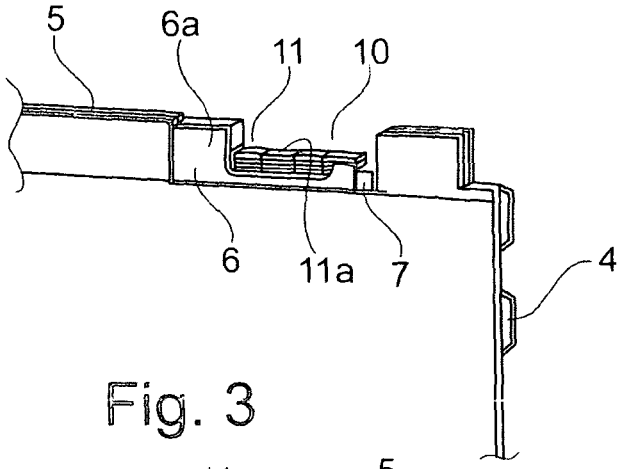
FIG. 3 illustrates an inner view of a foldable side wall of a large container.
Figure 4:
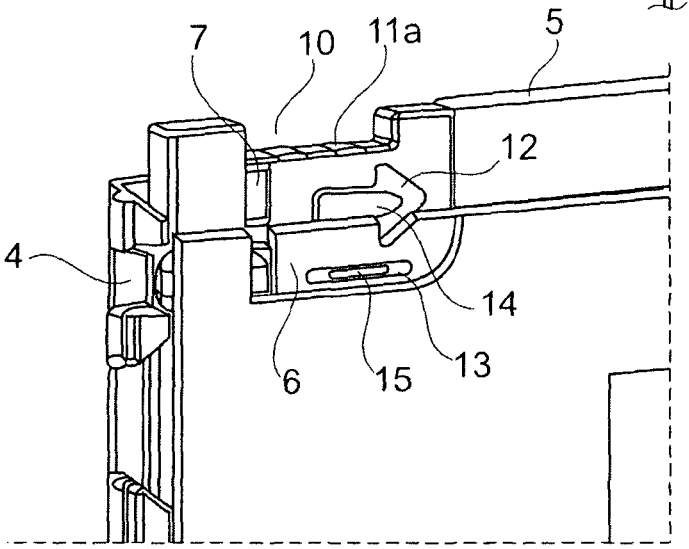
FIG. 4 illustrates an exterior view of the foldable side wall with a handle element of a locking device in opening direction.

FIG. 2 illustrates a handle component 6 which rides on an elongated support bar 7 in a recess 10 at the upper edge 5 of the side wall 4 and is thus moveably supported. For this purpose the handle component 6 includes a respective groove which reaches over the support bar 7. This fact is also apparent from FIGS. 4 and 5. The handle component 6 includes a step designated 11 which defines a handle shoulder 6*a* which acts as a sliding stop as apparent from a comparison of FIG. 4 and FIG. 6. The step 11 is essentially configured for hand width, forms a shoulder shaped support bar 11*a* and can be provided with slightly protruding bulges or protrusions as evident in particular from FIGS. 3-6, wherein the bulges or protrusions are rounded in order to improve the handling capabilities. Due to the step 11 and the handle shoulder 6*a* actuating the bar is facilitated from both sides of the side wall, thus from the inside and from the outside. It is evident that the support shoulder 11*a* is used as a support component thus including a groove which communicates with the support bar 7. The handle component 6*a* protrudes in upward direction from the support shoulder 11*a*. The handle component 6*a* and the support shoulder 11*a* as illustrated in the figures define an opening that is accessible from both sides, so that the locking can be disengaged from the inside and the outside of the container.

It is furthermore evident from the figures that the moveable handle component 6 is configured smaller or narrower with respect to height and thickness than the shoulder recess 10 or the thickness of the side wall 5, so that the handle component neither protrudes laterally nor in elevation direction. The handle component 6 is thus arranged slightly recessed with respect to the side wall 5 in a particular sense. Since the support bar 7 is a component of the side wall 5, the side wall 5 also forms the support for the handle element 6.

Alternatively or additionally to this support or to this stop one or plural recesses 12, 13 can be provided in the handle element 6. Furthermore preferably respective protrusions 14, 15 configured as bars and/or pins are configured at the foldable side wall. Two elongated recesses 12, 13 are provided at the outer surface of the side wall, wherein the recesses are arranged at a distance above one another. The upper recess 12 is configured arrow shaped. Support bars configured at the side wall engage the recesses. This assures support for the handle component without canting. The support bars are configured elongated and include a shorter length than the length of the recesses. Furthermore, the actuation of the locking device is particularly intuitive when at least one of the recesses 12, 13 is arrow shaped and/or the respective bars 14, 15 include an arrow shape corresponding thereto. This indicates to the user in a simple manner in which direction the handle component 6 has to be moved in order to disengage the locking between the foldable side wall 4 and the side wall 8 connected there to. The handle component 6 can be snap locked in a simple manner onto the side wall and over the protrusions 14, 15 and is then moveably supported on the side wall.

Figure 5:
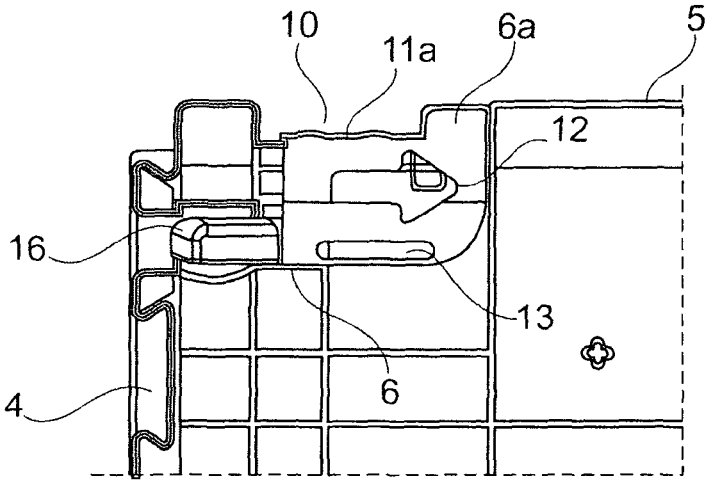
FIG. 5 illustrates a sectional view of a foldable side wall according to FIG. 4 and the handle element in opening position.

As illustrated in particular in FIG. 5, the handle component 6 is permanently coupled with an engagement lug 16, e.g. integrally configured therewith, wherein the engagement lug is evident from as sectional view of the foldable side wall 4 according to FIG. 5. In this illustration, however, only the foldable side wall 4 is illustrated in a sectional view, whereas the handle component 6 is not illustrated in a sectional view. In this illustration the lug 16 is completely pulled back into the foldable side wall 4 and the handle element 6 is disposed at the stop in opening direction.

Figure 6:
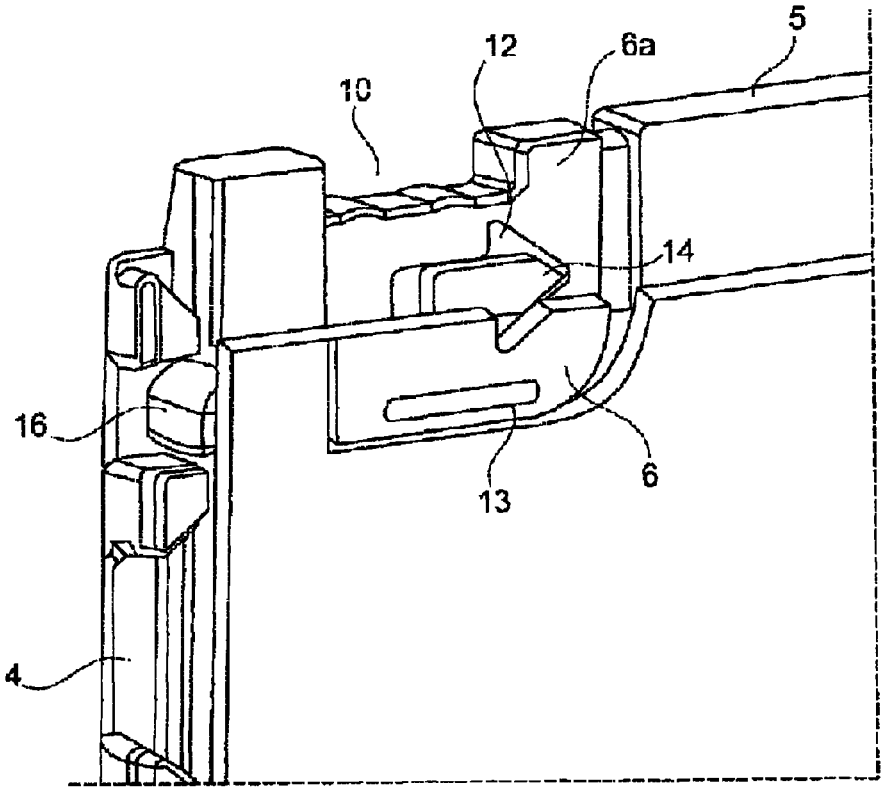
FIG. 6 illustrates a foldable side wall according to FIG. 4 with the handle element in closed position.
Figure 7:
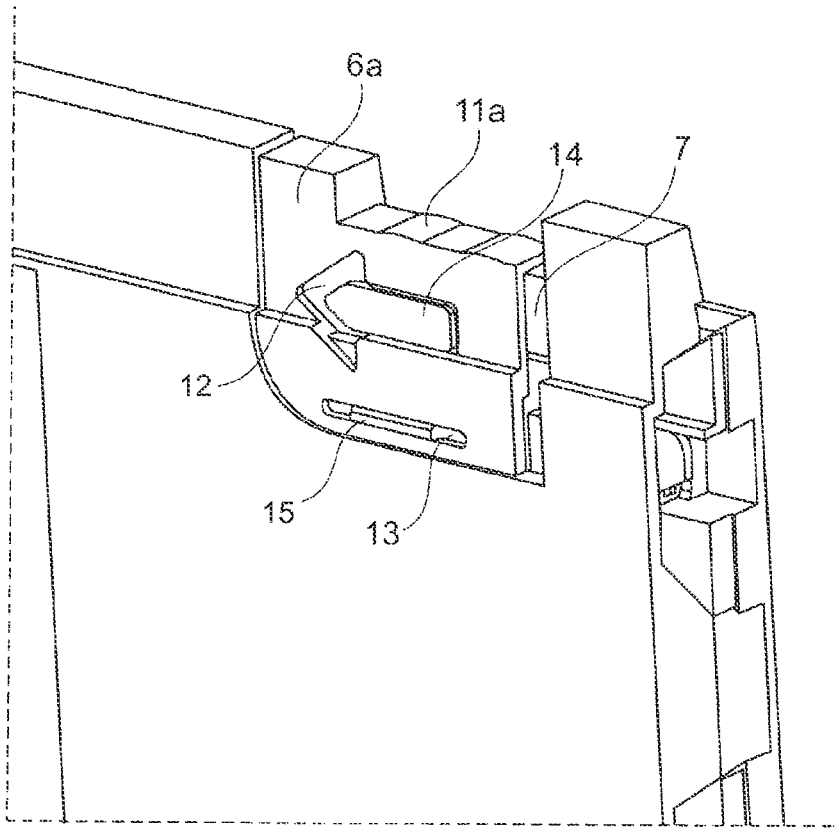
FIGS. 7 and 8 illustrate schematic partial views of a handle component from outside and inside the container.
Figure 8:
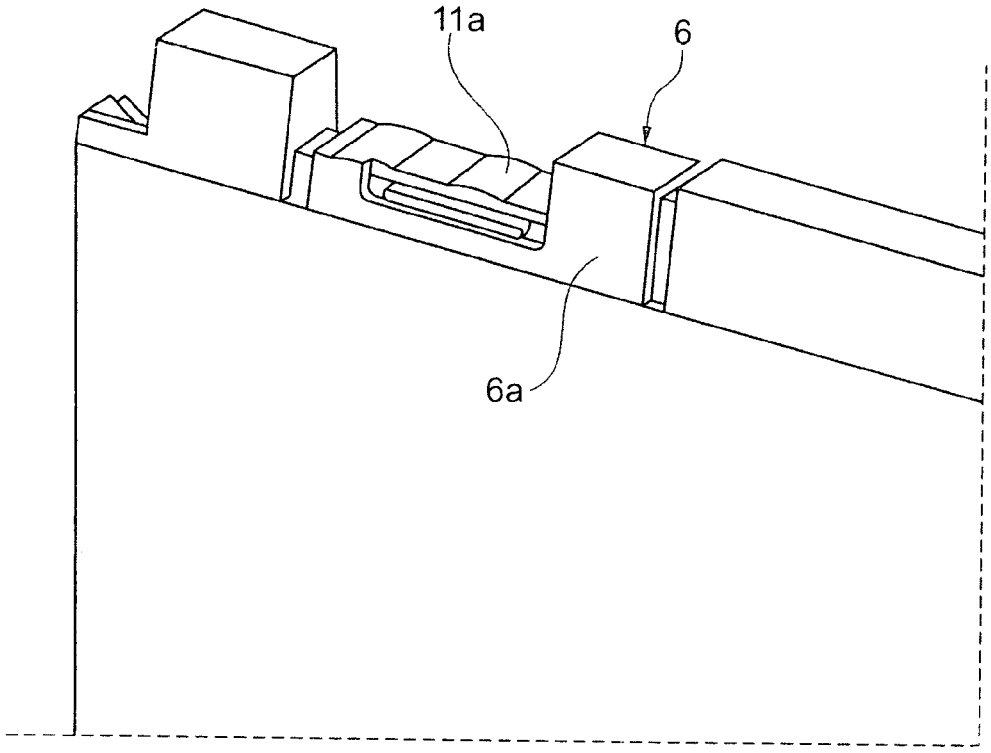

FIG. 6 illustrates the foldable side wall 4 with the handle element 6 and the lug 16 in closing position in which the lug protrudes beyond a lateral edge of the wall 4 and protrudes into an engagement recess which is not illustrated or behind a respective engagement bar of the adjacent side wall 8 in order to facilitate the locking of the adjacent walls. These details are not illustrated herein since engagement locks of this type for containers are known and primarily the handle element configuration and arrangement is important.

The invention is not limited to the described embodiments. For example the locking mechanism can include an additional locking mechanism alternatively or in addition to the lug. For example the locking mechanism can be used to transform a movement of the handle element 6 for example to cover a long locking path for a short actuation path or in order to achieve a short locking path with strong locking through a long actuation path. Furthermore the transmission can be used for covering a distance between the locking device and the edge of the side wall 8 connected there to in particular when only one locking device is provided per foldable side wall 4. Furthermore the handle element 6 can also be arranged without a recess of the foldable side wall 4. A stop can be exclusively formed through the actuation path of the lug 6. The recess 10 can also be configured remote from the edge 5 oriented away from the base component 3. Preferably, however, each side wall includes two handle bars in the upper edge portions which can be comfortably moved with both hands in directions towards one another for opening. Thereafter the side wall can be folded down directly through pressure onto the handle elements.

The invention claimed is:

1. A large container comprising:

a base component;

four circumferentially arranged side walls coupled to the base component, the four side walls including at least one foldable side wall coupled to the base component with at least one hinge, the at least one foldable side wall being configured to move between an upright position and a folded position;

at least one locking device configured to couple the at least one foldable side wall to at least one adjoining side wall when the at least one foldable side wall is in the upright position, the at least one locking device including a handle element; and an engagement lug coupled to the handle element, the handle element being configured to move between a locked position where the engagement lug engages the at least one adjoining side wall and a disengaged position where the engagement lug does not engage the at least one adjoining side wall;

wherein the at least one locking device is positioned in a recess of the at least one foldable side wall and is actuatable from the inside and the outside of the large container;

wherein the at least one locking device is positioned at an upper edge of the at least one foldable side wall;

wherein the handle element is movably supported on a support bar positioned in the recess of the at least one foldable side wall;

wherein the handle element has a stepped shape and includes a handle shoulder that stops movement of the handle element when it reaches the disengaged position; and wherein the at least one foldable side wall includes a protrusion that engages a recess in the handle element.

2. The large container according to claim 1, wherein the at least one foldable sidewall includes at least two of the locking devices where one of the at least two locking devices being positioned on one end of the at least one foldable sidewall and the other one of the at least two locking devices being positioned on an opposite end of the at least one foldable sidewall.

3. The large container according to claim 1, wherein the at least one locking device is positioned adjacent to a side edge of the at least one foldable sidewall extending vertically from the base component to the upper edge of the at least one foldable sidewall.

4. The large container according to claim 1, wherein the handle element moves toward the center of the upper edge of the at least one foldable sidewall when the handle element moves to the disengaged position and moves away from the center of the upper edge of the at least one foldable sidewall when the handle element moves to the locked position.

5. The large container according to claim 1, wherein the recess in the handle element is shaped like an arrow and the arrow points in the direction the handle element moves to reach the disengaged position.

6. The large container according to claim 5, wherein the protrusion in the at least one foldable sidewall is shaped like an arrow.

7. The large container according to claim 1, wherein the handle element is positioned in the recess of the at least one foldable sidewall and the at least one foldable sidewall forms a stop for the handle element.

8. The large container according to claim 1, wherein the handle element includes a groove configured to receive the support bar.

* * * * *